US009732289B2

(12) United States Patent
Lim et al.

(10) Patent No.: US 9,732,289 B2
(45) Date of Patent: Aug. 15, 2017

(54) INTEGRATED PROCESS FOR CONVERSION OF VACUUM GAS OIL AND HEAVY OIL

(71) Applicant: UOP LLC, Des Plaines, IL (US)

(72) Inventors: Hosoo Lim, Mount Prospect, IL (US); Trung Pham, Mount Prospect, IL (US); Zhihao Fei, Naperville, IL (US); Grant H. Yokomizo, Mount Prospect, IL (US); Ping Sun, Riverside, IL (US)

(73) Assignee: UOP LLC, Des Plaines, IL (US)

( * ) Notice: Subject to any disclaimer, the term of this patent is extended or adjusted under 35 U.S.C. 154(b) by 517 days.

(21) Appl. No.: 14/317,660

(22) Filed: Jun. 27, 2014

(65) Prior Publication Data

US 2015/0376515 A1 Dec. 31, 2015

(51) Int. Cl.

| | |
|---|---|
| ***C10G 69/04*** | (2006.01) |
| ***C10G 11/18*** | (2006.01) |
| ***C10G 47/26*** | (2006.01) |
| ***C10G 69/12*** | (2006.01) |
| ***C10G 50/00*** | (2006.01) |
| ***C10G 57/02*** | (2006.01) |

(52) U.S. Cl.

CPC ..... *C10G 69/04* (2013.01); *C10G 11/18* (2013.01); *C10G 47/26* (2013.01); *C10G 50/00* (2013.01); *C10G 57/02* (2013.01); *C10G 69/126* (2013.01); *C10G 2300/1074* (2013.01); *C10G 2300/4081* (2013.01); *C10G 2400/20* (2013.01)

(58) Field of Classification Search

CPC ..... C10G 69/04; C10G 69/126; C10G 47/26; C10G 11/18

See application file for complete search history.

(56) References Cited

U.S. PATENT DOCUMENTS

| | | | | |
|---|---|---|---|---|
| 4,764,268 | A | 8/1988 | Lane | |
| 5,609,751 | A * | 3/1997 | Wall | B01J 29/405 208/133 |
| 5,985,136 | A | 11/1999 | Brignac et al. | |
| 6,565,739 | B2 | 5/2003 | Winter | |
| 7,323,099 | B2 | 1/2008 | Henry | |
| 7,790,018 | B2 | 9/2010 | Khan | |
| 8,518,244 | B2 | 8/2013 | Schorfheide et al. | |
| 8,551,323 | B2 | 10/2013 | Abdel-Halim et al. | |

(Continued)

FOREIGN PATENT DOCUMENTS

CN 102453541 B 11/2013

OTHER PUBLICATIONS

Wang et al., "Study of cracking FCC naphtha in a secondary riser of the FCC unit for maximum propylene production," Fuel Processing Technology (2008), 89(9), 864-873.

(Continued)

*Primary Examiner* — Renee Robinson

(74) *Attorney, Agent, or Firm* — James C. Paschall

(57) ABSTRACT

An integrated process and apparatus for conversion of gas oil and heavy oil is described. The process includes passing a gas oil feed to a fluid catalytic cracking (FCC) zone to obtain a FCC effluent; separating the FCC effluent in a separation zone into at least two fractions comprising a clarified slurry oil fraction and an overhead fraction; passing the clarified slurry oil fraction to a slurry hydrocracking zone forming at least a naphtha stream; and recycling at least a portion of the slurry hydrocracking naphtha stream to the FCC zone.

19 Claims, 2 Drawing Sheets

(56) References Cited

U.S. PATENT DOCUMENTS

| | | | | |
|---|---|---|---|---|
| 2001/0042700 | A1* | 11/2001 | Swan, III | C10G 69/04 208/68 |
| 2005/0121361 | A1* | 6/2005 | Duplan | C10G 11/18 208/113 |
| 2008/0156696 | A1* | 7/2008 | Niccum | C10G 11/04 208/78 |
| 2009/0127161 | A1 | 5/2009 | Haizmann et al. | |
| 2009/0129998 | A1 | 5/2009 | Haizmann et al. | |
| 2010/0122934 | A1 | 5/2010 | Haizmann et al. | |
| 2010/0155300 | A1 | 6/2010 | Sabottke et al. | |
| 2010/0329936 | A1 | 12/2010 | Van Wees et al. | |
| 2011/0139681 | A1* | 6/2011 | McGehee | C10G 21/003 208/96 |
| 2012/0024748 | A1 | 2/2012 | Subramani et al. | |
| 2013/0240406 | A1 | 9/2013 | Sadler et al. | |

OTHER PUBLICATIONS

Verstraete et al., "Study of direct and indirect naphtha recycling to a resid FCC unit for maximum propylene production," Catalysis Today (2005), vol. 106, 62-71.

Sundaram et al., "Propylene Production from Fluid Catalytic Cracking Process," Proceedings of the 11th AlChE Ethylene Producers Conference (1999), vol. 8, 791-806.

* cited by examiner

INTEGRATED PROCESS FOR CONVERSION OF VACUUM GAS OIL AND HEAVY OIL

BACKGROUND OF THE INVENTION

As the cost of crude oils increases, in order to improve the profit for the refinery industry, heavy oils must be upgraded to meet demands. In upgrading, the heavier materials are converted to lighter fractions and most of the sulfur, nitrogen and metals must be removed. Crude oil is typically first processed in an atmospheric crude distillation tower to provide fuel products including naphtha, kerosene and diesel. The atmospheric crude distillation tower bottoms stream is typically taken to a vacuum distillation tower to obtain vacuum gas oil (VGO) that can be feedstock for an FCC unit or other uses. VGO typically boils in a range between at or about 300° C. (572° F.) and at or about 524° C. (975° F.).

Processing these heavier feeds results in increased amounts of the bottoms stream from the vacuum distillation tower, leading to increased amounts of less valuable products being produced.

Therefore, there is a need for processes and apparatus to increase the amount of valuable products such as petrochemicals (ethylene, propylene, aromatics) made from the heavier feeds and reduce the amount of less valuable products.

SUMMARY OF THE INVENTION

One aspect of the invention involves an integrated process for conversion of vacuum gas oil and heavy oil. In one embodiment, the process includes passing a gas oil feed to a fluid catalytic cracking (FCC) zone to obtain a FCC effluent; separating the FCC effluent in a separation zone into at least two fractions comprising a clarified slurry oil fraction and an overhead fraction; passing the clarified slurry oil fraction to a slurry hydrocracking zone forming at least a naphtha stream; and recycling at least a portion of the slurry hydrocracking naphtha stream to the FCC zone.

Another aspect of the invention is an apparatus for conversion of gas oil and heavy oil. The apparatus includes a hydrotreating zone having an inlet and an outlet; a FCC zone having a feed inlet, at least one recycle inlet, and an effluent outlet, the FCC deed inlet in fluid communication with the outlet of the hydrotreating zone; a separation zone having an inlet, at least one upper outlet, and a lower outlet, the separation zone inlet in fluid communication with the FCC zone outlet; and a slurry hydrocracking zone having an inlet and at least two outlets, the slurry hydrocracking zone inlet in fluid communication with the lower outlet of the separation zone, one of the outlets of the slurry hydrocracking zone in fluid communication with the at least one recycle inlet of the FCC zone, and one of the outlets of the slurry hydrocracking zone being in fluid communication with the inlet of the hydrotreating zone.

DETAILED DESCRIPTION OF THE INVENTION

The FCC process is one of the primary processes used to produce gasoline and high grade propylene in refineries worldwide. When the refineries need to process heavy feeds, such as vacuum residue, a slurry hydrocracking unit can be integrated with the FCC unit to convert feeds efficiently to increased amounts of gasoline or propylene, depending on the operation of the units. The clarified slurry oil from the FCC process can be sent to the slurry hydrocracking (SHC) unit along with a vacuum residue stream from a vacuum distillation tower, for example. The naphtha and gas oil streams from the SHC unit can be recycled to the FCC unit, directly (naphtha) or indirectly (gas oil). At least a portion of the naphtha stream from the SHC unit, can be recycled to the FCC unit and cracked to produce more propylene. The remainder of the naphtha from the SHC unit can be combined with FCC naphtha for gasoline blending. FCC naphtha in propylene mode has higher aromatic content than SHC naphtha. In addition, light ends from the SHC unit can be recovered in the gas recovery section for additional ethylene and propylene.

Figure 1:
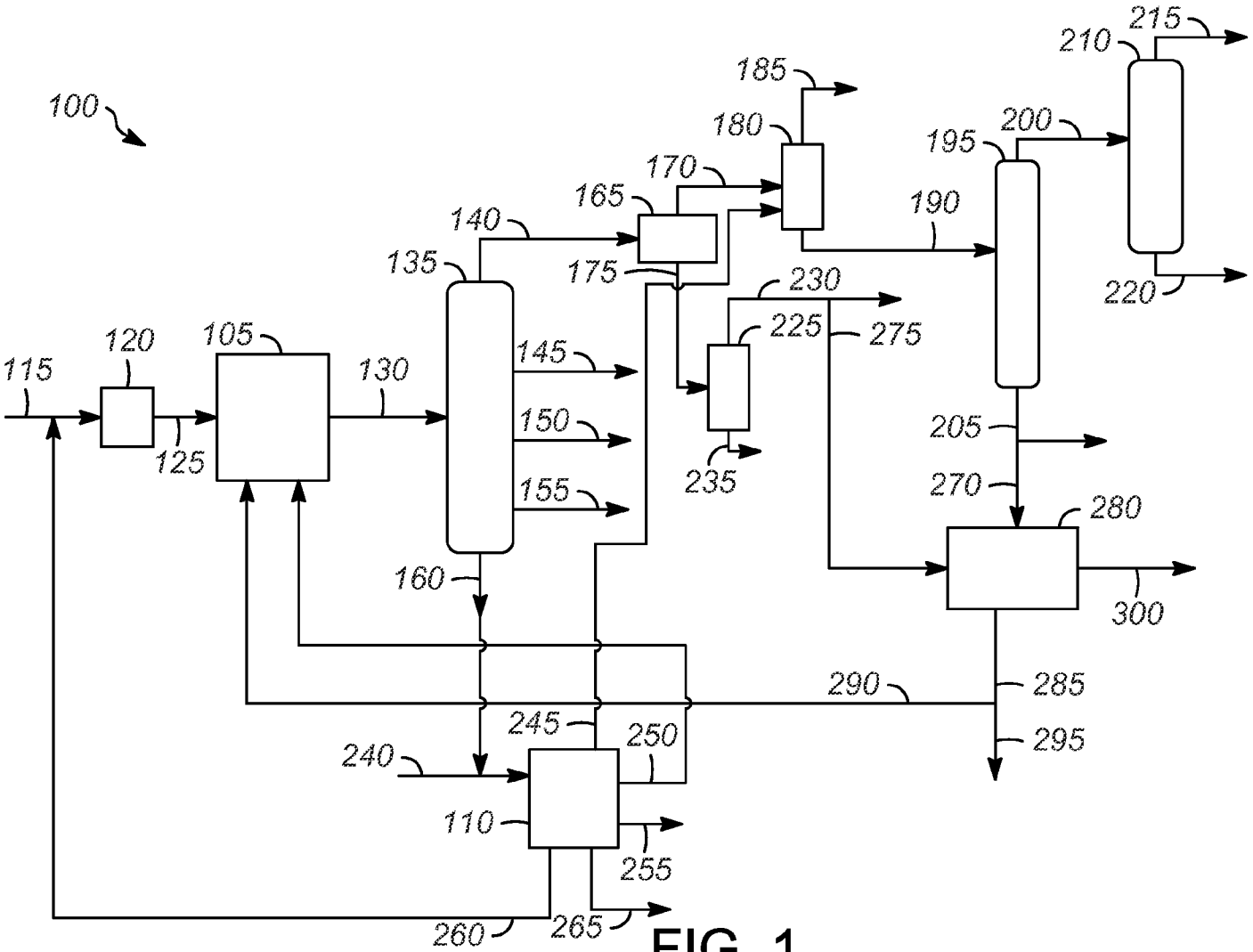
FIG. 1 illustrates one embodiment of an integrated process for conversion of vacuum gas oil and heavy oil.

As shown in FIG. 1, the process 100 incorporates an FCC reaction zone 105 and a slurry hydrocracking (SHC) reaction zone 110. The gas oil feed 115 is sent to a hydrotreater 120 to remove sulfur, nitrogen, and other contaminants. The gas oil feed 115 can be the vacuum gas oil (VGO) stream (boiling point of 340-570° C. (650-1050° F.)) from a vacuum distillation tower, or an atmospheric gas oil stream (boiling point of 260-340° C. (500-650° F.)), for example. For ease of description, the gas oil feed 115 will be referred to as VGO.

The hydrotreated VGO feed 125 is introduced into the FCC reaction zone 105. The hydrotreated VGO may undergo separation to remove lower boiling product streams before being fed to the FCC reaction zone 105. FCC is a catalytic hydrocarbon conversion process accomplished by contacting heavier hydrocarbons in a fluidized reaction zone with a catalytic particulate material. The reaction in catalytic cracking is carried out in the absence of substantial added hydrogen or the consumption of hydrogen. The process typically employs a powdered catalyst having the particles suspended in a rising flow of feed hydrocarbons to form a fluidized bed. In representative processes, cracking takes place in a riser, which is a vertical or upward sloped pipe. Typically, a pre-heated feed is sprayed into the base of the riser via feed nozzles where it contacts hot fluidized catalyst and is vaporized on contact with the catalyst, and the cracking occurs converting the high molecular weight oil into lighter components including liquefied petroleum gas (LPG), gasoline, and a distillate. The catalyst-feed mixture flows upward through the riser for a short period (a few seconds), and then the mixture is separated in cyclones. The hydrocarbons are directed to a fractionator for separation into LPG, gasoline, diesel, kerosene, jet fuel, and other possible fractions. While going through the riser, the cracking catalyst is deactivated because the process is accompanied by formation of coke which deposits on the catalyst particles. Contaminated catalyst is separated from the cracked hydrocarbon vapors and is further treated with steam to remove hydrocarbon remaining in the pores of the catalyst. The catalyst is then directed into a regenerator where the coke is burned off the surface of the catalyst particles, thus restoring the catalyst's activity and providing the necessary heat for the next reaction cycle. The process of cracking is endothermic. The regenerated catalyst is then used in the new cycle. Typical FCC conditions include a temperature of about 400° C. to about 800° C., a pressure of about 0 to about 688 kPa g (about 0 to 100 psig), and contact times of about 0.1 seconds to about 15 seconds. The conditions are determined based on the hydrocarbon feedstock being cracked, and the cracked products desired. Zeolite-based catalysts are commonly used in FCC reactors, as are composite catalysts which contain zeolites, silica-aluminas, alumina, and other binders.

The hydrotreated VGO feed 125 is cracked into lighter hydrocarbons in the FCC reaction zone 105. The FCC effluent 130 is separated into two or more streams in a main fractionation column 135.

As illustrated in FIG. 1, the FCC effluent 130 is sent to a main fractionation column 135 where it is separated into at least two streams, a clarified slurry oil stream comprising the bottoms residual from the main fractionation column and having a boiling point above 343° C. (650° F.) and at least one additional stream having a boiling point below 343° C. (650° F.). The FCC effluent is typically separated into more than two streams.

For example, the FCC effluent can be separated into an overhead fraction 140, a heavy naphtha fraction 145, a light cycle oil fraction 150, a heavy cycle oil fraction 155, and a clarified slurry oil fraction 160, for example. The overhead fraction typically includes FCC products having a boiling point range of up to 95° C. (203° F.). The heavy naphtha fraction comprises products having a boiling point range of 95° C. (203° F.) to 221° C. (429° F.). The light cycle oil fraction comprises products having a boiling point range of 221° C. (429° F.) to 343° C. (650° F.). The heavy cycle oil fraction 155 comprises products having a boiling point range of starting from 343° C. (650° F.). The clarified slurry oil fraction 160 comprises the bottoms residual from the main fractionation column and has a boiling point above 343° C. (650° F.). As will be understood by those of skill in the art, the FCC effluent 130 can be separated into more or fewer streams depending on the needs of the refinery.

The overhead fraction 140 is cooled, condensed, and sent to an overhead receiver 165 where it is separated into a $C_{4-}$ stream 170 and a $C_{5+}$ stream 175. (Reflux stream to the main fractionation column is implicit and not shown).

The $C_{4-}$ stream 170 is compressed and sent to a $C_2/C_3$ splitter column 180 where it is separated into a fuel gas stream 185, and a $C_3$-$C_4$ stream 190. The fuel gas stream 185 typically comprises hydrogen, methane, ethane, and ethylene. Ethylene can be further recovered in an olefin recovery unit (not shown) if required.

The $C_3$-$C_4$ stream 190 is sent to a $C_3/C_4$ splitter column 195 where the propane/propylene fraction 200 is separated from the $C_4$ stream 205.

The propane/propylene fraction 200 can be separated in a $C_3$ splitter 210 into a propylene stream 215 and a propane stream 220.

The $C_{5+}$ stream 175 from the receiver 165 is sent to a depentanizer column 225 where it is split into a $C_5$ stream 230 and a $C_{6+}$ (FCC light naphtha stream) 235. The $C_{5+}$ stream 175 may have some $C_4$ hydrocarbons in it; when it is separated in the depentanizer column 225, the $C_4$ hydrocarbons are contained in the $C_5$ stream 230.

The $C_4$ stream 205 and the $C_5$ stream 230 can be blended together, if desired.

Additional separation can take place, if desired. For example, the $C_4$ stream 205 could be separated into butane and butene streams in a $C_4$ splitter, or the $C_5$ stream 230 could be split into pentane and pentene streams in a $C_5$ splitter.

The clarified slurry oil fraction 160 is sent to the SHC reaction zone 110. The clarified slurry oil fraction 160 is combined with a vacuum residue stream 240. The vacuum residue stream 240 can come from the vacuum distillation tower bottoms, for example.

SHC is used for the primary upgrading of heavy hydrocarbon feedstocks obtained from the distillation of crude oil, including hydrocarbon residues or gas oils from atmospheric column or vacuum column distillation. In SHC, these liquid feedstocks are mixed with hydrogen and solid catalyst particles, e.g., as a particulate metallic compound such as a metal sulfide, to provide a slurry phase. Representative SHC processes are described, for example, in U.S. Pat. Nos. 5,755,955 and 5,474,977. SHC produces naphtha, diesel, gas oil such as VGO, and a low-value, refractory pitch stream. The VGO streams are typically further refined in catalytic hydrocracking or fluid catalytic cracking (FCC) to provide saleable products. To prevent excessive coking in the SHC reactor, heavy VGO (HVGO) can be recycled to the SHC reactor. SHC enables conversion of up to 80-95 wt-% of many low value vacuum bottoms streams to 524° C. (975° F.) and lighter distillate and a small quantity of pitch.

In the SHC reaction zone 110, heavy feed and hydrogen react in the presence of the aforementioned catalyst to produce slurry hydrocracked products. The SHC reaction zone 110 can be operated at a pressure range of 3.5 to 32 MPa, with relatively low controlled formation of coke or mesophase. The reactor temperature is typically in the range of about 350° C. to about 600° C., or about 400° C. to about 500° C. The LHSV is typically below about 4 $h^{-1}$ on a fresh feed basis, or in the range of about 0.05 to about 3 $hr^{-1}$, or about 0.1 to about 1 $hr^{-1}$, or about 0.1 to about 0.5 $hr^{-1}$. The pitch conversion may be at least about 80 wt-%, suitably at least about 85 wt-% and preferably at least about 90 wt-%. The hydrogen feed rate is about 236 to about 3370 $Nm^3/m^3$ (1400 to about 20,000 SCF/bbl) oil. SHC is particularly well suited to a tubular reactor through which feed and gas move upwardly. Hence, the outlet from SHC reaction zone is above the inlet.

The products of SHC can be separated into various streams in a separation zone (not shown) in the SHC reaction zone 110. The separation zone can include one of more flash drums, stripping columns, and fractionation columns, and other equipment as is known in the art. For example, the products can be separated into light ends stream 245, a SHC naphtha stream 250, distillate stream 255, a SHC VGO stream 260 (SHC VGO includes LVGO with a boiling point range of 343° C. (650° F.) to 427° C. (800° F.) and HVGO with a boiling point range of 427° C. (800° F.) to 524° C. (975° F.), and pitch stream 265. Light ends stream 245 with a distillation endpoint up to 85° C. (185° F.), which contains hydrogen, $CO_x$, and $C_{3-}$ hydrocarbons, is sent to the $C_2/C_3$ splitter column 180 for further processing. The light ends stream 245 from the SHC unit has a very low concentration of olefins compared to the FCC light ends. Distillate stream 255, with a boiling point range of 204° C. (400° F.) to 343° C. (650° F.), can be recovered as product or further hydrotreated to remove contaminants, depending on product specification targets. Pitch stream 265, with a boiling point range greater than 524° C. (975° F.), can be sent for further processing, if desired. For example, the pitch stream 265 can be sent to a pitch deasphalting unit to produce a high grade asphalt product for road blends.

Separation of the products of SHC can be done in the SHC reaction zone 110, as described above. In other embodiments, the SHC products can be sent to the main fractionation column 135 for recovery of both FCC and SHC products (not shown). In this case, the column will need to be larger to handle the additional flow. However, the overall capital cost may be less because the separation zone in the SHC reaction zone will be reduced. The bottoms stream from the main fractionation column 135 can then be sent for further separation into VGO, CSO, and pitch, for example, with the VGO being recycled to the FCC reaction zone and the CSO being sent to the SHC reaction zone. There can be one or more slurry settlers to remove fines from the bottoms stream before the recycle, if needed. However, catalyst from the SHC reaction zone 110 can be managed in the FCC reaction zone 105, and catalyst from the FCC reaction zone 105 can be managed in the SHC reaction zone 110.

The SHC naphtha stream 250 with a boiling point range of 85° C. (185° F.) to 204° C. (400° F.), which contains gasoline range materials $C_{5+}$, including paraffins, olefins, napthentics, and aromatics, is recycled to the FCC reaction zone 105 for further cracking to light olefins.

The SHC VGO stream 260 is blended with VGO feed stream 115 and recycled to the hydrotreater 120.

A portion 270 (or all) of the $C_4$ stream 205 from the C3/C4 splitter column 195 and/or a portion 275 (or all) of the $C_5$ stream 230 from the depentanizer column 225 can be sent to an optional light olefin oligomerization zone 280. Oligomerization is a process for converting light olefins from FCC or other processes into higher carbon chain length, olefinic gasoline or jet fuel blendstocks via dimerization, trimerization by an oligomerization mechanism over acid catalysts. Typically, heavier olefins are desired products and paraffins are by-products. In the overall reaction, one olefin reacts with another same or more olefins to form a heavier olefinic compound. The effluent product may be hydroprocessed to meet certain fuel specifications.

Representative oligomerization processes and catalysts are described, for example, in U.S. Pat. Nos. 5,059,737, 2,116,151 and 2,275,182. The oligomerization zone 245 can be operated at a pressure range of 0.6 to 16 MPa. The reactor temperature is in the range of 100° to 390° C., or about 140° to 290° C. The LHSV is from 0.1 to 50 $hr^{-1}$, or about 0.5 to 25 $hr^{-1}$, using solid phosphoric acid or a zeolite catalyst.

At least a portion 290 of the oligomerized product 285, which is $C_{8+}$ olefinic hydrocarbons, is recycled to the FCC reaction zone 105. A portion 295 of the oligomerized product can be recovered, if desired. Saturated $C_4$ and $C_5$ hydrocarbons 300 can be rejected and sent for further processing, for example, isomerization to isomerates, dehydrogenation to olefins, or alkylation with olefins to alkylates.

As shown in FIG. 1, the SHC naphtha can be injected into the riser of the FCC reaction zone 105. However, depending on the capacity of the SHC unit and the product flowrate of the SHC naphtha, a second riser may be added to the FCC reaction zone. The SHC naphtha can be sent to the second riser where it is selectively cracked to produce propylene.

Figure 2:
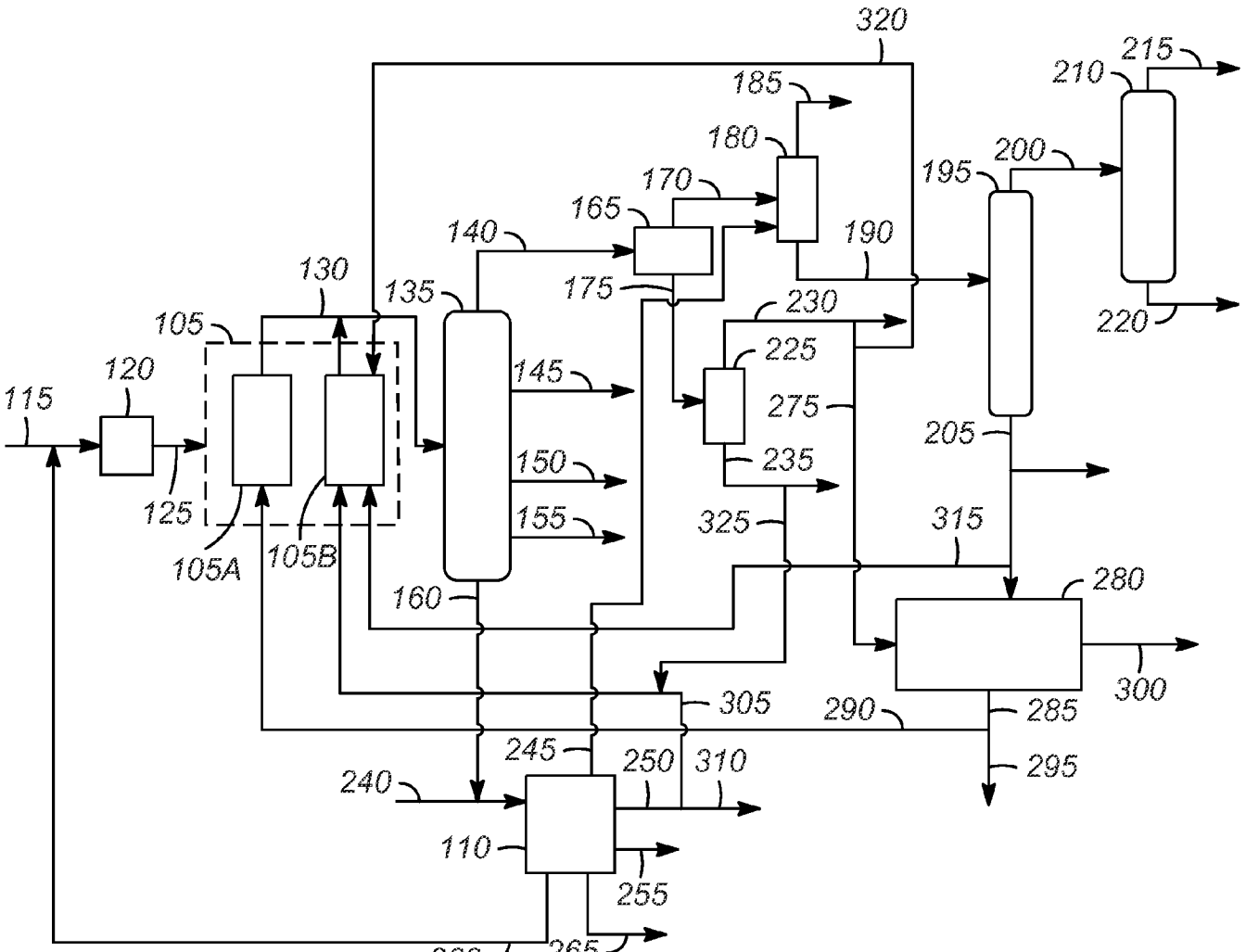
FIG. 2 illustrates another embodiment of an integrated process for conversion of vacuum gas oil and heavy oil.

FIG. 2 shows the alternate embodiment in which the FCC reaction zone 105 includes at least two risers 105A and 105B. A portion 305 of the SHC naphtha stream 250 is sent to the second riser 105B. The portion 290 of the oligomerized product 285, if present, can be recycled to the first riser 105A at an upper injection point above the VGO feed injection point for short residence time. Alternatively, the oligomerized product 285 can be sent to a separate oligomer cracking reactor (not shown).

The rest 310 of the SHC naphtha 250 can be combined with the FCC heavy naphtha stream 145 to be the final naphtha product. Blending the FCC heavy naphtha 145 with the SHC naphtha 310 may lower the aromatic content by dilution. Note that at high severity operation, FCC gasoline may contain as high as 35 to 50% aromatic content by volume.

Optionally, all or a portion 315 of the $C_4$ stream 205 from the C3/C4 splitter 195 and/or all or a portion 320 of the $C_5$ stream 275 from the depentanizer 225 can be sent to the second riser 105B for cracking instead of to the optional oligomerization unit 280 to produce effluent which is rich in propylene.

Optionally, at least a portion 325 of the FCC $C_{6+}$ stream 235 can be combined with the portion 305 of the SHC naphtha stream 250, and the combined stream can be recycled to the FCC zone 105. This recycle desirably occurs in the embodiment containing two FCC risers, and the recycle of the combined stream is desirably sent to the second riser. The rest of $C_{6+}$ product 235 may go to an isomerization unit to produce isomerate products or be recovered as product.

Optionally, at least a portion of the FCC heavy naphtha stream 145 is sent to an extractive distillation zone (not shown) to extract the aromatics from the raffinate comprising paraffins. The paraffins can be recovered as a product or sent for further processing, as needed.

The various options described apply to either or both of FIGS. 1 and 2, as applicable.

Example

A simulation was run using a straight run VGO feed (boiling point of 340+° C. (650+° F.)). The feed has a relative density of 22.91 API, UOP Characterization Factor K of 11.96, 0.10 ppm-wt of nickel, 0.15 ppm-wt vanadium, 2.300 wt % of sulfur, 856 ppm-wt of nitrogen, and a Conradson carbon residue of 0.71 wt %.

In the aforementioned feed definition, the UOP Characterization Factor K, commonly referred as UOP K, is indicative of the general origin and nature of a petroleum stock. Values of 12.5 or higher indicate a material predominantly paraffinic in nature. Highly aromatic materials have characterization factors of 10.0 or less.

An example of the products and yields (on weight basis) for an FCC riser without an oligomerization unit is listed in Table 1.

TABLE 1

| Products | Yield (wt %) |
|---|---|
| C2- | 5.36 |
| C3 propylene | 16.9 |
| Total C3 | 18.52 |
| Total C4 | 17.55 |
| Debut. Gasoline | 35.5 |
| LCO | 10 |
| CSO | 5.9 |
| Coke | 7.17 |

Another example of products and yields (on weight basis) for SHC pilot plant at 94% conversion is shown in Table 2.

TABLE 2

| SHC example | Yield (wt %) |
|---|---|
| C3- | 10.95 |
| Naphtha | 29.02 |
| Distillate | 37.03 |
| LVGO | 12.02 |
| HVGO | 4.98 |
| Pitch | 6.0 |

Yield estimates based on integration of a single riser FCC unit with SHC, including SHC naphtha and VGO recycles to the FCC for additional propylene production, are shown in Table 3. The flow throughput ratio of FCC to SHC is 5:1 on weight basis. Also, Total Delta refers to weight percent increment from recycling SHC naphtha and VGO back to the FCC riser reactor.

TABLE 3

| Combined FCC SHC Case | Yield (wt %) | Total Delta (wt %) |
|---|---|---|
| C2- | 5.36 | 0.81 |
| Propylene | 16.9 | 2.65 |
| Total C3 | 18.52 | 2.89 |
| Total C4 | 17.55 | 1.62 |
| Debut. Gasoline | 35.5 | 1.77 |
| LCO | 10 | 0.92 |
| CSO | 5.9 | 0.54 |
| Coke | 7.17 | 0.65 |

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. An integrated process for conversion of vacuum gas oil and heavy oil comprising:

passing a gas oil feed to a fluid catalytic cracking (FCC) zone to obtain a FCC effluent;

separating the FCC effluent in a separation zone into at least two fractions comprising a clarified slurry oil fraction and an overhead fraction;

passing the clarified slurry oil fraction to a slurry hydrocracking zone forming at least a naphtha stream; and recycling at least a portion of the slurry hydrocracking naphtha stream to the FCC zone.

2. The process of claim 1 further comprising:

forming a gas oil stream in the slurry hydrocracking zone; and recycling the slurry hydrocracking gas oil stream to the FCC zone.

3. The process of claim 1 further comprising combining the clarified slurry oil fraction with a vacuum residue fraction before passing the clarified slurry oil fraction to the slurry hydrocracking zone.

4. The process of claim 1 further comprising:

forming a distillate stream in the slurry hydrocracking zone; and recovering the distillate stream.

5. The process of claim 1 further comprising:

separating the overhead fraction into at least two portions, a first portion comprising at least one of butenes and pentenes and a second portion;

passing the first portion to an oligomerization zone to produce an oligomerization effluent;

recycling the oligomerization effluent to the FCC zone.

6. The process of claim 5 wherein the FCC zone comprises at least two FCC risers, and:

wherein passing the gas oil feed to the FCC zone comprises passing the gas oil feed to the first FCC riser;

wherein recycling the oligomerization effluent to the FCC zone comprises recycling the oligomerization effluent to the first FCC riser.

7. The process of claim 1 wherein the FCC zone comprises at least two FCC risers, and:

wherein passing the gas oil feed to the FCC zone comprises passing the gas oil feed to the first FCC riser; and wherein recycling at least the portion of the slurry hydrocracking naphtha stream to the FCC zone comprises recycling at least the portion of the slurry hydrocracking naphtha stream to the second FCC riser.

8. The process of claim 1 wherein the FCC zone comprises at least two FCC risers, and wherein the FCC effluent comprises an FCC effluent from the first FCC riser and an FCC effluent from the second FCC riser.

9. The process of claim 1 further comprising hydrotreating the gas oil feed before passing the gas oil feed to the FCC zone.

10. The process of claim 1 further comprising separating the overhead fraction into at least one of a fuel gas fraction, a $C_{6+}$ fraction, a $C_3$-$C_4$ fraction, a $C_3$ fraction, a $C_4$ fraction, a $C_5$ fraction, a propane fraction, and a propylene fraction.

11. The process of claim 10 further comprising:

forming a light ends stream in the slurry hydrocracking zone; and combining the slurry hydrocracking light ends stream with at least a portion of the overhead fraction.

12. The process of claim 10 wherein the FCC zone comprises at least two FCC risers, and wherein passing the gas oil feed to the FCC zone comprises passing the gas oil feed to the first FCC riser, and wherein the overhead stream is separated into at least one of the $C_4$ fraction, or $C_5$ fraction; and further comprising:

recycling the $C_4$ fraction, or the $C_5$ fraction, or both to the second FCC riser.

13. The process of claim 1 wherein separating the FCC effluent in the separation zone into the at least two fractions comprises separating the FCC effluent in the separation zone into the clarified slurry oil fraction, the overhead fraction, and at least one of a gasoline fraction and a light cycle oil fraction.

14. The process of claim 1 further comprising:

forming a pitch stream in the slurry hydrocracking zone; and passing the pitch stream to a pitch deasphalting unit to produce a high grade asphalt product.

15. The process of claim 1 wherein separating the FCC effluent in the separation zone into the at least two fractions comprises separating the FCC effluent in the separation zone into the clarified slurry oil fraction, the overhead fraction, and a $C_{6+}$ fraction, and further comprising:

combining at least a portion of the $C_{6+}$ fraction with at least the portion of the slurry hydrocracking naphtha stream;

and wherein recycling at least the portion of the slurry hydrocracking naphtha stream to the FCC zone comprises recycling the combined stream to the FCC zone.

16. The process of claim 15 wherein the FCC zone comprises at least two FCC risers, and wherein passing the gas oil feed to the FCC zone comprises passing the gas oil feed to the first FCC riser, and wherein recycling the combined stream to the FCC zone comprises recycling the combined stream to the second FCC riser.

17. The process of claim 1 wherein separating the FCC effluent in the separation zone into the at least at least two fractions comprises separating the FCC effluent in the separation zone into the clarified slurry oil fraction, the overhead fraction, and a FCC heavy naphtha fraction, and further comprising:

passing at least a portion of the FCC heavy naphtha fraction to an extractive distillation zone to form an aromatics stream.

18. An integrated process for conversion of gas oil and heavy oil comprising:

hydrotreating a gas oil feed;

passing the hydrotreated gas oil feed to a fluid catalytic cracking (FCC) zone to obtain a FCC effluent;

separating the FCC effluent in a separation zone into at least two fractions comprising a clarified slurry oil fraction and an overhead fraction;

combining the clarified slurry oil fraction with a vacuum residue fraction;

passing the combined clarified slurry oil fraction and vacuum residue fraction to a slurry hydrocracking zone forming at least a naphtha stream, and a gas oil stream;

recycling at least a portion of the slurry hydrocracking naphtha stream to the FCC zone;

recycling the slurry hydrocracking gas oil stream to the FCC zone;

separating the overhead fraction into at least one of a fuel gas fraction, a $C_{6+}$ fraction, a $C_3$-$C_4$ fraction, a $C_3$ fraction, a $C_4$ fraction, a $C_5$ fraction, a propane fraction, and a propylene fraction.

19. The process of claim 18 wherein separating the overhead fraction into at least one of a fuel gas fraction, a $C_{6+}$ fraction, the $C_3$-$C_4$ fraction, the $C_3$ fraction, the $C_4$ fraction, the $C_5$ fraction, the propane fraction, and the propylene fraction comprises separating the overhead fraction into at least one of the $C_4$ fraction and the $C_5$ fraction; and further comprising:

passing at least a portion of at least one of the $C_4$ fraction and the $C_5$ fraction to an oligomerization zone to produce an oligomerization effluent; and recycling the oligomerization effluent to the FCC zone.

* * * * *